US009612566B2

(12) United States Patent
Nakata

(10) Patent No.: US 9,612,566 B2
(45) Date of Patent: Apr. 4, 2017

(54) IMAGE FORMING APPARATUS

(71) Applicant: SAMSUNG ELECTRONICS CO., LTD., Suwon-si (KR)

(72) Inventor: Masashi Nakata, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/173,049

(22) Filed: Jun. 3, 2016

(65) Prior Publication Data

US 2016/0282800 A1 Sep. 29, 2016

Related U.S. Application Data

(63) Continuation of application No. PCT/KR2014/011608, filed on Dec. 1, 2014.

(30) Foreign Application Priority Data

Dec. 9, 2013 (JP) ..... 2013-254069
Nov. 27, 2014 (KR) ..... 10-2014-0167813

(51) Int. Cl.
*G03G 21/00* (2006.01)
*G03G 15/16* (2006.01)
*G03G 21/12* (2006.01)

(52) U.S. Cl.
CPC ..... *G03G 21/00* (2013.01); *G03G 15/161* (2013.01); *G03G 21/12* (2013.01)

(58) Field of Classification Search
CPC ..... G03G 21/00; G03G 21/12; G03G 15/161
See application file for complete search history.

(56) References Cited

U.S. PATENT DOCUMENTS 4,711,561 A * 12/1987 Tsuruoka ..... G03G 21/12 399/35
7,373,092 B2 5/2008 Tawada
7,991,308 B2 8/2011 Oh
8,428,475 B2 4/2013 Tomita et al.
2002/0181962 A1* 12/2002 Henricus ..... G03G 21/12 399/35

(Continued)

FOREIGN PATENT DOCUMENTS

JP 2000-75749 3/2000
JP 2001-305924 11/2001

(Continued)

OTHER PUBLICATIONS

International Search Report issued Feb. 26, 2015 in corresponding International Patent Application No. PCT/KR2014/011608.

*Primary Examiner* — G. M. Hyder
(74) *Attorney, Agent, or Firm* — Staas & Halsey LLP

(57) ABSTRACT

An image forming apparatus 1 includes a transfer belt unit 71 that is movable along a circumference of a roller rotation axis A2 and transfers an image held in a photosensitive drum 40 to paper P, a waste toner receiving container 73 that receives accumulated waste toner 72 collected from the transfer belt unit 71, and a full state detection unit FG including a waste toner amount detection unit 82, disposed inside the waste toner receiving container 73 to detect the amount of waste toner. The full state detection unit FG detects a full state in a loaded state switched from a non-buried state.

19 Claims, 13 Drawing Sheets

(56) References Cited

U.S. PATENT DOCUMENTS

| | | | | |
|---|---|---|---|---|
| 2005/0163545 | A1* | 7/2005 | Cook | G03G 21/12 399/358 |
| 2005/0254841 | A1* | 11/2005 | Tomitaka | G03G 15/0872 399/12 |
| 2007/0264036 | A1* | 11/2007 | Craig | G03G 21/105 399/35 |
| 2010/0119270 | A1* | 5/2010 | Hoshino | G03G 21/105 399/358 |

FOREIGN PATENT DOCUMENTS

| | | |
|---|---|---|
| JP | 3826751 | 7/2006 |
| JP | 4621470 | 11/2010 |
| JP | 2010-271473 | 12/2010 |
| JP | 2011-85734 | 4/2011 |
| JP | 2012-42790 | 3/2012 |
| KR | 10-2010-0046616 | 5/2010 |

* cited by examiner

FIG. 12

| | | FIRST ANGLE D2 OF REPOSE OF WASTE TONER (° ) | | | | |
|---|---|---|---|---|---|---|
| | | 0 | 10 | 20 | 30 | 40 |
| INCLINED ANGLE D1 OF WASTE TONER AMOUNT DETECTION UNIT (° ) | 0 | × | × | × | × | × |
| | 10 | × | × | × | × | × |
| | 20 | × | × | × | × | × |
| | 30 | × | △ | △ | × | × |
| | 40 | △ | △ | △ | △ | × |
| | 50 | ○ | ○ | △ | △ | △ |
| | 60 | ○ | ○ | ○ | ○ | △ |
| | 70 | ○ | ○ | ○ | ○ | ○ |

IMAGE FORMING APPARATUS

CROSS-REFERENCE TO RELATED APPLICATIONS

This application is a continuation under 35 U.S.C. §111(a), which claims the benefit under 35 U.S.C. §371 of PCT International Patent Application No. PCT/KR2014/011608, filed Dec. 1, 2014, which claims the foreign priority benefit under 35 U.S.C. §119 of Japanese Patent Application No. 2013-254069, filed Dec. 9, 2013, and Korean Patent Application No. 10-2014-0167813, filed Nov. 27, 2014, the contents of which are incorporated herein by reference.

TECHNICAL FIELD

The present disclosure relates to an image forming apparatus having a full state detection function of detecting a full state of waste toner.

BACKGROUND ART

An image forming apparatus such as a copy machine and a printer based on electrophotography includes a waste toner receiving container that receives waste toner collected from a conveying belt or an intermediate transfer belt. The amount of waste toner that may be received is set in advance in a waste toner receiving container, such that the waste toner receiving toner is replaced with another one when the amount of waste toner reaches a preset amount. The number of operations with respect to the waste toner receiving container may be reduced by detecting the amount of waste toner with high precision, such that various techniques for detecting the amount of waste toner with high precision have been proposed.

In Patent Document 1, an image forming apparatus capable of detecting a full state of waste toner with a simple structure is disclosed. A waste toner receiving container of the image forming apparatus is provided with a light-receiving/emitting unit having a light-emitting element and a light-receiving element, and a reflection plate. If light beams emitted from the light-emitting element are not detected by the light-receiving element after being reflected from the reflection plate, then the image forming apparatus detects that the waste toner is in the full state.

However, in an element referred to as a light-transmission sensor disclosed in Patent Document 1, light beams are blocked by waste toner floating in the waste toner receiving container, resulting in false detection. Thus, full state detection devices that perform detection mechanically rather than optically are proposed in Patent Document 2 and Patent Document 3.

Patent Document 2 discloses a waste toner collecting device capable of detecting a full state of waste toner with high precision. A waste toner collecting container of the waste toner collecting device is provided with a movable member whose position is changed by an increase in waste toner in the waste toner collecting container and a full detector having a sensor to detect a change in the position of the movable member. Patent Document 3 discloses a waste toner collecting container that detects a full state by using a displacement sensor. In an upper portion of the waste toner collecting container is mounted the displacement sensor that detects displacement caused by pressurization of swelling waste toner. Inside the waste toner collecting container, a waste toner conveying means is disposed. If the amount of waste toner reaches a predetermined amount, the waste toner conveying means conveys waste toner horizontally and pressurizes the waste toner to flatten the height.

PRIOR TECHNICAL DOCUMENT

Patent Document

[Patent Document 1] Japanese Patent Publication Gazette No. 2000-75749

[Patent Document 2] Japanese Patent Registration No. 3826751

[Patent Document 3] Japanese Patent Registration No. 462147

DETAILED DESCRIPTION OF THE INVENTION

Technical Problem

However, waste toner may be accumulated at a side due to opening and closing of a side cover on which a waste toner collecting container is mounted. In this case, if an apex portion of the waste toner is optically or mechanically detected as in Patent Documents 1 and 2, the full state is detected erroneously even if the waste toner is not in the full state, degrading the precision of the full state detection. According to Patent Document 3, tool for conveying the waste toner is required, complicating the structure of the device.

Therefore, the present disclosure provides an image forming apparatus capable of improving the precision of detection of a full state of waste toner with a simple structure.

Technical Solution

An image forming apparatus according to an embodiment of the present disclosure includes a transfer member configured to transfer a toner image, a cleaning unit configured to remove waste toner remaining on the transfer member, a waste toner receiving member configured to receive the waste toner removed by the cleaning unit, and a full state detection unit including a waste toner amount detection unit disposed in the waste toner receiving member to detect an amount of waste toner and configured to detect whether the waste toner is fully filled in the waste toner receiving member by using the waste toner amount detection unit, in which the waste toner amount detection unit is movable in a buried state in which the waste toner amount detection unit is positioned under a surface of the waste toner received in the waste toner receiving member, in a non-buried state in which the waste toner amount detection unit is positioned above the surface of the waste toner, and in a loaded state in which the waste toner amount detection unit contacts the surface of the waste toner, and the full state detection unit detects whether the waste toner is fully filled in the waste toner receiving member when the waste toner amount detection unit is positioned in the loaded state switched from the non-buried state.

In an embodiment, the transfer member is movable, and the waste toner amount detection unit switches to the buried state, the non-buried state, or the loaded state in cooperation with movement of the transfer member.

In an embodiment, the transfer member is movable in an away state in which the transfer member is spaced apart by a predetermined distance from an image holding member in which a toner image is held and in a close state in which the transfer member is closer to the image holding member than in the away state, and in the full state detection unit, the waste toner amount detection unit switches from the buried state to the non-buried state to correspond to movement of the transfer member from the close state to the away state, and switches from the non-buried state to the loaded state to correspond to movement of the transfer member from the away state to the close state.

In an embodiment, the full state detection unit is configured to be pressurized in contact with the transfer member when the transfer member moves from the close state to the away state, and the full state detection unit is configured to be released from the contact pressurization by the transfer member when the transfer member moves from the away state to the close state.

In an embodiment, the full state detection unit includes a rotatable shaft on which the waste toner amount detection unit is mounted and a link portion that protrudes from the shaft toward the transfer member and is contactable to the transfer member.

In an embodiment, the waste toner amount detection unit has a trapezoid cross section and has a top surface, a bottom surface having a wider width than the top surface, and a pair of inclined surfaces connecting the top surface with the bottom surface.

In an embodiment, an angle between the inclined surface and the bottom surface of the waste toner amount detection unit is greater than a first angle of repose that is an angle between a bottom surface and an inclined surface of the waste toner received in the waste toner receiving member.

In an embodiment, the waste toner amount detection unit includes an outer frame portion forming a first opening portion and a split-beam portion disposed in the first opening portion to divide the first opening portion into a plurality of second opening portions.

In an embodiment, a total area of the second opening portions is greater than and equal to about 0.1 $mm^2$ and less than and equal to about 300 $mm^2$.

In an embodiment, at least one of the outer frame portion and the split-beam portion has a trapezoid cross section including a pair of inclined surfaces, and an angle between the pair of inclined surfaces is a second angle of repose that is an angle between inclined surfaces of the waste toner received in the waste toner receiving member.

In an embodiment, the image forming apparatus may further include a control unit configured to control operations of the transfer member and the full state detection unit.

In an embodiment, the control unit is configured to perform non-buried control for switching the waste toner amount detection unit from the buried state to the non-buried state by moving the transfer member from the close state to the away state, to perform loading control for switching the waste toner amount detection unit from the non-buried state to the loaded state by moving the transfer member from the away state to the close state after performing the non-buried control, and to perform determination control for determining whether the waste toner is in a full state after performing the loading control.

In an embodiment, the control unit is configured to control image formation when the waste toner amount detection unit is in the buried state.

In an embodiment, the image forming apparatus further includes a waste toner stirring unit configured to flatten the waste toner received in the waste toner receiving member.

In an embodiment, the control unit performs flattening control for flattening the waste toner by operating the waste toner stirring unit after performing the loading control and before performing the determination control.

In an embodiment, the waste toner stirring unit operates in cooperation with movement of the transfer member.

In an embodiment, the waste toner receiving member is rotatable.

In an embodiment, the image forming apparatus further includes an actuator configured to provide a rotation force and a connection portion disposed between the actuator and the transfer member and configured to deliver the rotation force of the actuator to the transfer member, in which by the rotation force of the actuator, the transfer member moves in an away state in which the transfer member is spaced apart by a predetermined distance from an image holding member in which a toner image is held and in a close state in which the transfer member is closer to the image holding member than in the away state.

In an embodiment, the image forming apparatus further includes a case on which an image holding member in which a toner image is held is fixedly installed and a cover configured to open and close the case and on which the transfer member is mounted, in which by opening and closing of the cover, the transfer member moves in an away state in which the transfer member is spaced apart by a predetermined distance from an image holding member in which a toner image is held and in a close state in which the transfer member is closer to the image holding member than in the away state.

Effects of the Invention

According to an image forming apparatus of the present disclosure, the precision of detection of a full state of waste toner may be improved with a simple structure.

DESCRIPTION OF THE DRAWINGS

FIG. 12 is a table for describing Embodiment 2.

MODE OF THE INVENTION

Figure 1:
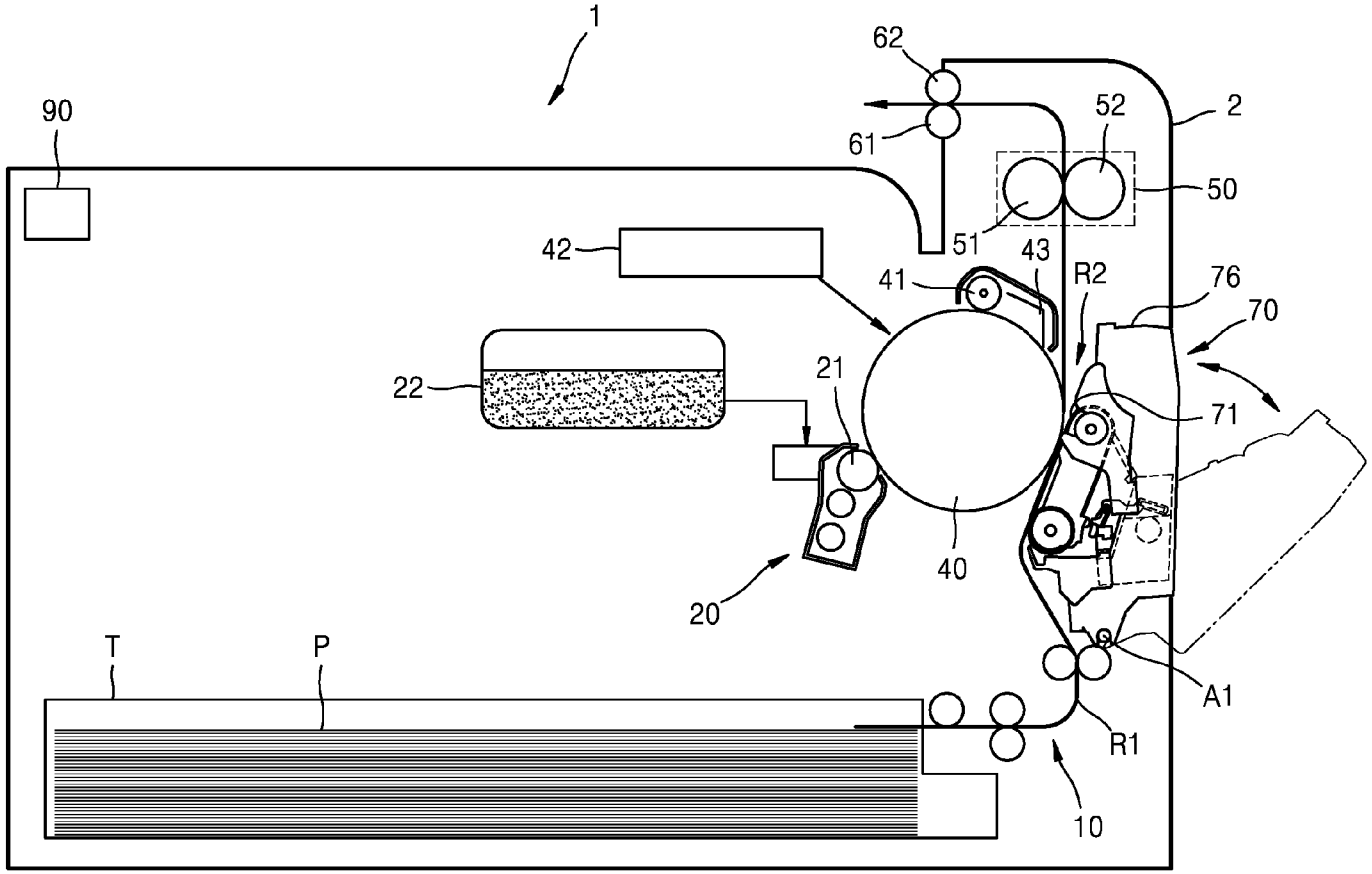
FIG. 1 illustrates a schematic structure of an image forming apparatus according to the present disclosure.

Hereinafter, a mode for carrying out the present disclosure will be described in detail with reference to the attached drawings. In a description of the drawings, like reference numerals will be given to like elements and a repetitive description will be omitted.

A basic structure of an image forming apparatus 1 will be described.

FIG. 1 illustrates a schematic structure of the image forming apparatus 1 according to an embodiment of the present disclosure. In the current embodiment, a monochromatic image forming apparatus is used as an example of the image forming apparatus 1, but the image forming apparatus 1 may also be a color image forming apparatus.

Referring to FIG. 1, the image forming apparatus 1 may include a recording medium conveying unit 10 that conveys paper (a transfer material) P, a developing unit 20 that develops an electrostatic latent image, a photosensitive drum 40 that is an image holding member on a circumferential surface of which an image is formed, a transfer member 70 that transfers the image to the paper P, and a fusing unit 50 that fuses a toner image on the paper P.

The recording medium conveying unit 10 receives the paper P as a recording medium on which an image is formed and conveys the paper P on a conveying path R1. The paper P is received by being stacked in a cassette T. The recording medium conveying unit 10 conveys the paper P to a transfer region R2 through the conveying path R1 at timing when the toner image transferred to the paper P reaches the transfer region R2.

The developing unit 20 includes a development roller 21 that dips toner into the photosensitive drum 40. The developing unit 20 dips a developing agent, produced by mixing and stirring toner and a carrier to be fully charged and mixing the toner and the carrier, into the development roller 21. If the developing agent is conveyed to a region facing the photosensitive drum 40 by rotation of the development roller 21, the toner included in the developing agent held into the development roller 21 moves the electrostatic latent image formed on the outer circumferential surface of the photosensitive drum 40, such that the electrostatic latent image is developed.

The developing unit 20 supplies a new developing agent therein and stirs and conveys the developing agent. The developing unit 20 may use a trickle development scheme that conveys a deteriorated developing agent that is a part of an excessive developing agent to outside. By using the trickle development scheme, the deteriorated developing agent is discharged and a fresh developing agent of the same amount as the discharged developing agent is supplied. The deteriorated developing agent in the developing unit 20 falls down to a deteriorated developing agent outlet and a deteriorated developing agent inlet, thus being received in a waste toner collecting device.

The transfer member 70 may include a transfer belt unit 71 (a transfer member) that pressurizes the photosensitive drum 40.

The developing unit 20, a conditioning roller 41, a writing unit 42, and a cleaning unit 43 are provided along a circumference of the photosensitive drum 40.

The conditioning roller 41 electrifies the surface of the photosensitive drum 40 with predetermined electric potential. The writing unit 42 exposes the surface of the photosensitive drum 40 electrified by the conditioning roller 41 to correspond to an image formed on the paper P. Thus, the potential of an exposed portion of the surface of the photosensitive drum 40 by the writing unit 42 is changed such that an electrostatic latent image is formed. Four developing units 20 develop an electrostatic latent image formed on the photosensitive drum 40 with toner supplied from a toner tank 22 provided facing each developing unit 20, thus generating a toner image. Black toner is filled in the toner tank 22.

The cleaning unit 43 collects toner remaining on the photosensitive drum 40 after the toner image formed on the photosensitive drum 40 is transferred onto the paper P. A screw is provided around the cleaning unit 43, and waste toner obtained by the cleaning unit 43 is conveyed by the screw. The waste toner conveyed by the screw is received in the waste toner collecting device along a convey path in a waste toner nozzle through a waste toner collection container port formed in an end portion of the waste toner nozzle.

The fusing unit 50 fuses, by attaching, the toner image transferred to the paper P from the photosensitive drum 40 onto the paper P. The fusing unit 50 may include a heat roller 51 for heating the paper P and a pressure roller 52 for pressurizing the heat roller 51. The heat roller 51 and the pressure roller 52 are formed in a cylindrical shape, and the heat roller 51 includes a heat source such as a halogen lamp therein. A fusing nip portion, which is a contact region, is provided between the heat roller 51 and the pressure roller 52, and the paper P is caused to pass through the fusing nip portion, such that the toner image is fused onto the paper P.

The image forming apparatus 1 is provided with discharge rollers 61 and 62 for discharging the paper P on which the toner image is fused by the fusing unit 50 to the outside of the image forming apparatus 1.

The image forming apparatus 1 may include a control unit 90 for controlling the recording medium convey unit 10, the developing unit 20, the transfer member 70, the photosensitive drum 40, and the fusing unit 50 described above. The control unit 90 is configured with a microcomputer, and a program prescribing an operation of each unit is stored in a memory and a program is executed to perform desired control.

In an embodiment described above, a two-element developing agent including a toner and a carrier is used as the developing agent, but the present disclosure is not limited thereto. A developing agent including at least a toner or a one-element developing agent including only a toner may be used. Although trickle development is used for development, the present disclosure is not limited thereto.

A description will be made of a detailed structure of an image forming apparatus including a full state detection unit according to the current embodiment of the present disclosure.

Figure 2:
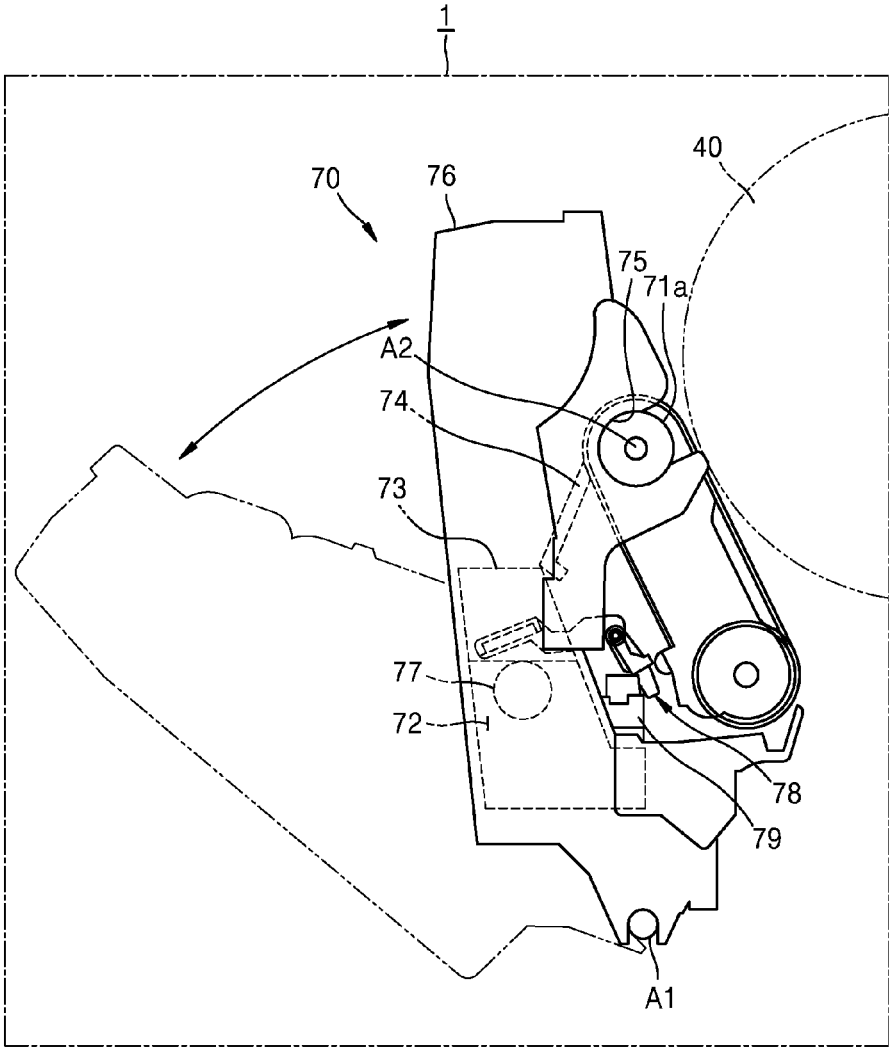
FIG. 2 is a side view illustrating a structure of main elements of an image forming apparatus including a full state detection unit.
Figure 3A:
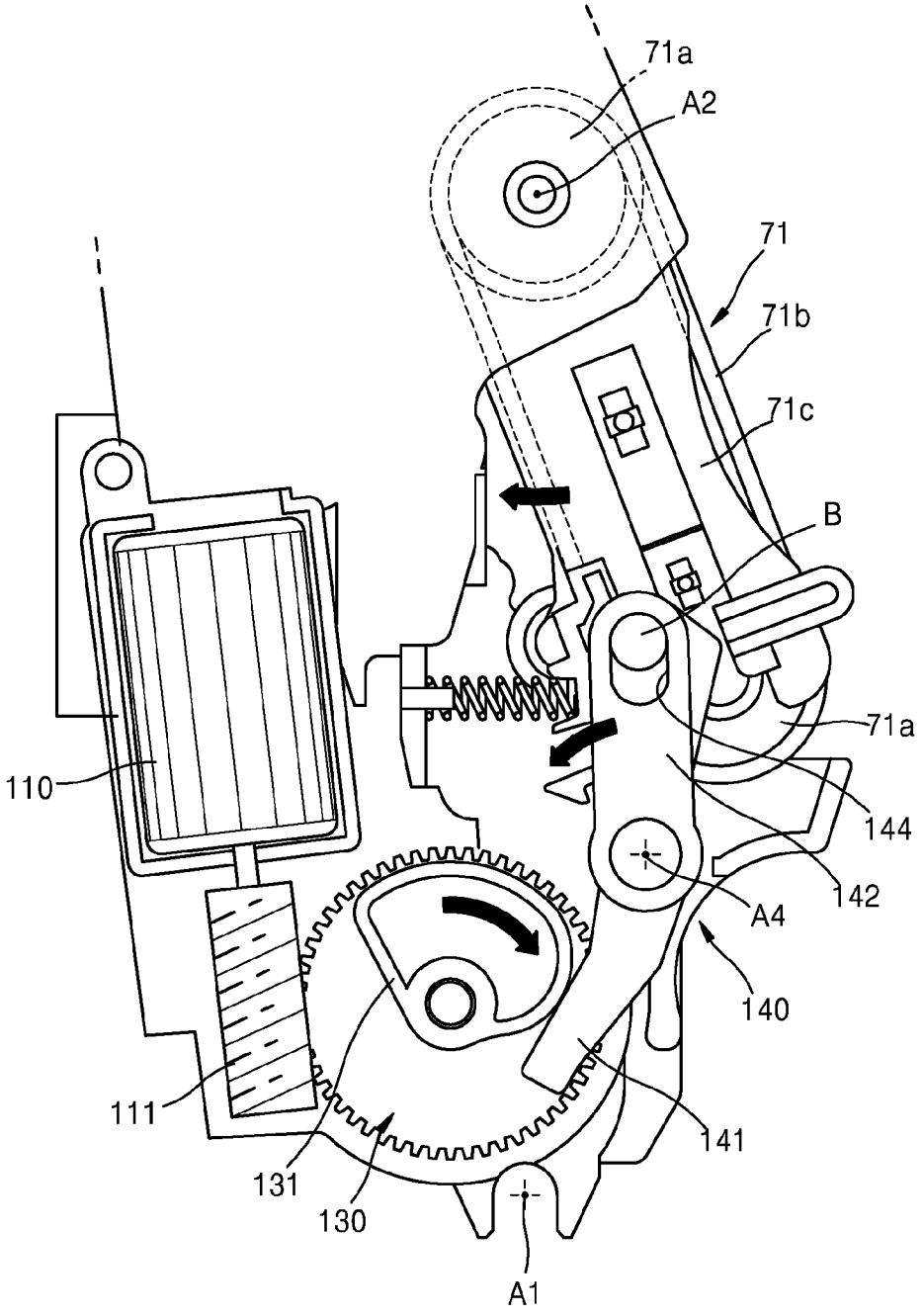
FIGS. 3A and 3B are views for describing rotational movement of a transfer belt unit of a transfer member.
Figure 3B:
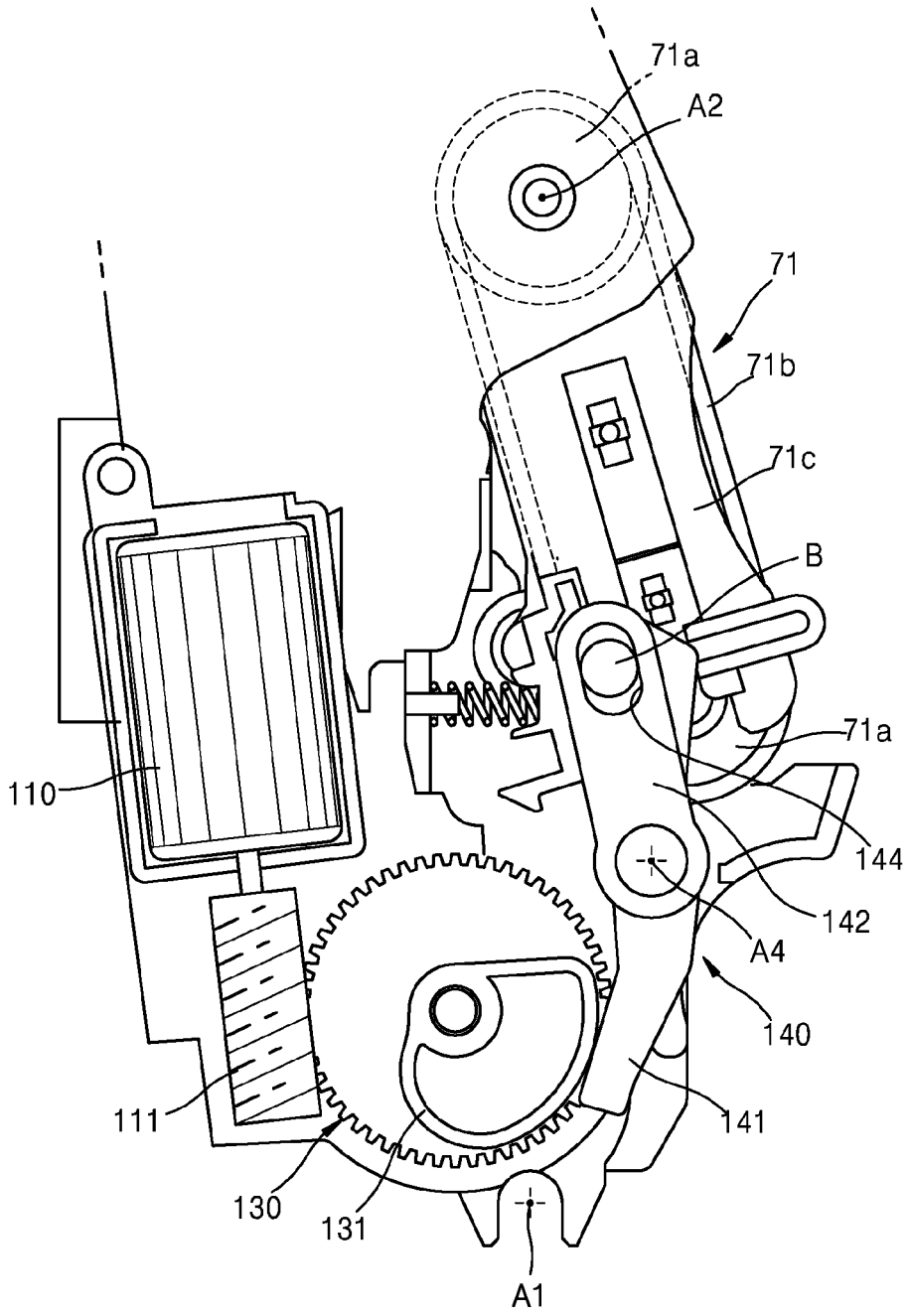
Figure 4:
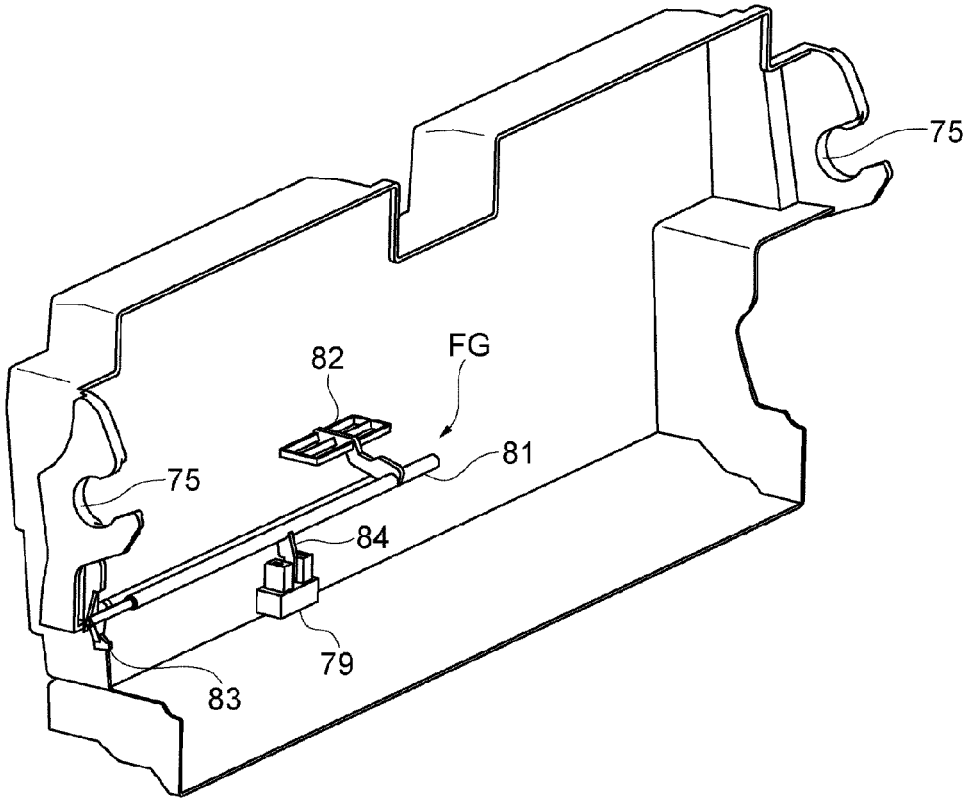
FIG. 4 is a perspective view illustrating arrangement of a full state detection unit.
Figure 5:
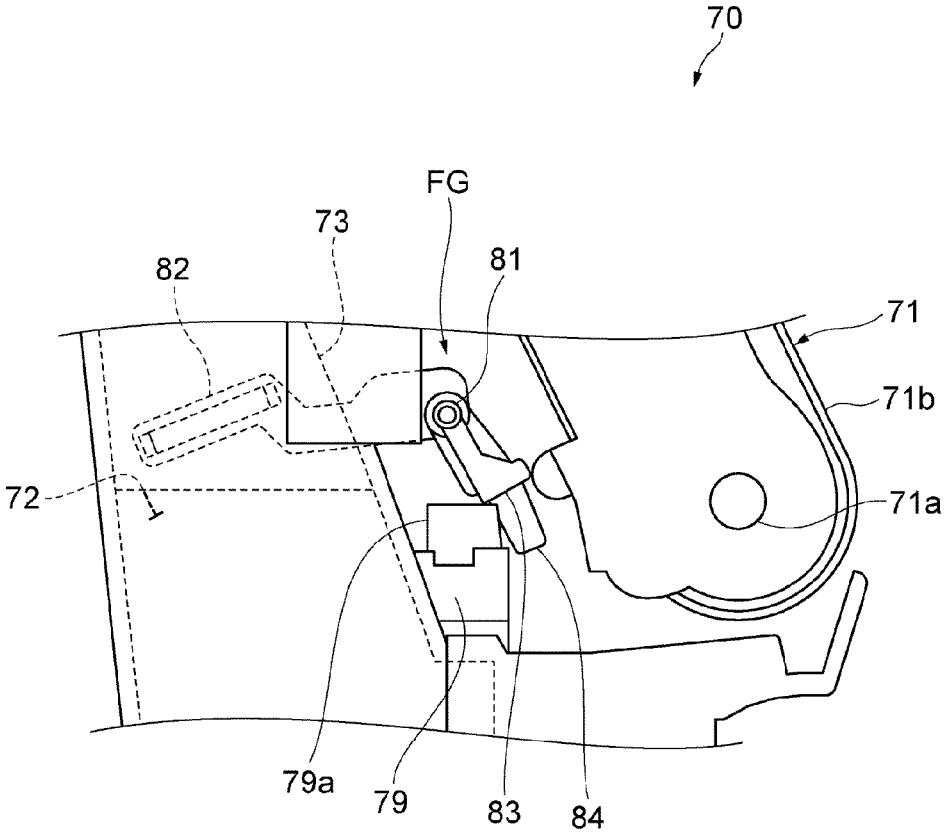
FIG. 5 is a side view illustrating a full state detection unit and a transfer member.

FIG. 2 is a side view illustrating a structure of main elements of an image forming apparatus including a full state detection unit. FIGS. 3A and 3B are views for describing rotational movement of a transfer belt unit of a transfer member. FIG. 4 is a perspective view illustrating arrangement of a full state detection unit. FIG. 5 is a side view illustrating a full state detection unit and a transfer member. In FIG. 2, for convenience of a description, the transfer member 70 of FIG. 1 is illustrated as being symmetrical.

Referring to FIGS. 2, 4, and 5, the transfer member 70 is integrally mounted onto a waste toner receiving container 73 (a waste toner receiving membermember) for receiving waste toner 72 removed from the transfer belt unit 71 (a transfer member). The transfer member 70 is configured to rotationally move around a rotation support portion A1 serving as a center of rotation. For example, the rotation support portion A1 is provided under the waste toner receiving container 73.

The transfer member 70 may include a cover 76 exposed to an exterior. As the transfer member 70 rotationally moves around the rotation support portion A1, a case 2 of the image forming apparatus 1 is open or closed as shown in FIG. 1. Since the photosensitive drum 40 is fixed on the case 2, the transfer belt unit 71 included in the transfer member 70 moves close to or away from the photosensitive drum 40 when the transfer member 70 rotationally moves.

When the case 2 of the image forming apparatus 1 is closed by the cover 76, the transfer belt unit 71 of the transfer member 70 moves close to or away from the photosensitive drum 40.

The transfer belt unit 71 may include a pair of suspension rollers 71*a* and a transfer belt 71*b* hung between the suspension rollers 71*a*. In the waste toner receiving container 73 is provided a rotation bearing portion 75 that overlaps a roller rotation axis A2 of the suspension rollers 71*a*. The suspension rollers 71*a* are inserted into the rotation bearing portion 75. With such a configuration, the transfer belt unit 71 rotationally moves around the rotation axis A2 serving as a center of rotation. Through such rotational movement, a close state (see FIGS. 9A and 9C) and an away state (see FIG. 9B) between the transfer belt unit 71 and the photosensitive drum 40 are achieved. The close state refers to a state in which the transfer belt unit 71 is close to the photosensitive drum 40 (see FIGS. 9A and 9C).

In this way, the transfer belt unit 71 moves close to and away from the photosensitive drum 40, such that damage or image defect of the transfer belt unit 71 and/or the photosensitive drum 40, which may occur in the case of continuous contact between the transfer belt unit 71 and the photosensitive drum 40, may be prevented.

Unlike in the current embodiment, when the transfer belt unit 71 continuously contacts the photosensitive drum 40, the photosensitive drum 40 and the transfer belt unit 71 may contact without using a recording medium in an image adjustment stage. In this case, due to a rotation speed difference between the photosensitive drum 40 and the transfer belt unit 71, at least one of the photosensitive drum 40 and the transfer belt unit 71 may be damaged and waste toner formed in the photosensitive drum 40 may contaminate the transfer belt unit 71. The transfer belt 71*b* of the transfer belt unit 71 may include a gum material having elasticity, and when the transfer belt unit 71 maintains continuous contact with the photosensitive drum 40, a trace may be left on the surface of the photosensitive drum 40 by the transfer belt unit 71, resulting in an image defect.

However, in the current embodiment, the transfer belt unit 71 moves close to and away from the photosensitive drum 40, thereby preventing damage or image defect of the transfer belt unit 71 and the photosensitive drum 40, which may occur in the case of continuous contact between the transfer belt unit 71 and the photosensitive drum 40.

Referring to FIGS. 3A and 3B, the transfer member 70 may include an actuator 110 having an output shaft 111 that outputs a rotational force (torque) and connecting portions 130 and 140 that connect the output shaft 111 with the transfer belt unit 71 to rotationally move the transfer belt unit 71. The actuator 110 may be a motor for rotational actuation.

The connecting portions 130 and 140 may include a connection gear 130 connected to the output shaft 111 to rotate and a connection link 140 that pivots by the connecting gear 130 and rotationally moves the transfer belt unit 71.

The connecting gear 130 may include a connection cam 131 that pressure-contacts the connection link 140. The connection cam 131 contacts an end portion 141 of the connection link 140. As the connecting gear 130 rotates, the end portion 141 of the connection link 140 is pressurized along the connection cam 131.

As the end portion 141 is pressurized, the connection link 140 rotates around a rotation axis A4 and another end portion 142 of the connection link 140 moves. On the another end portion 142 of the connection link 140, a connection hole 144 connected to a housing 71*c* of the transfer belt unit 71 is formed. A boss B formed in the housing 71*c* is inserted into the connection hole 144. The housing 71*c* in which the boss B is formed rotationally moves around the roller rotation axis A2 serving as the center of rotation due to movement of the another end portion 142 of the connection link 140. The housing 71*c*, as an element of the transfer belt unit 71, is a frame that supports the pair of suspension rollers 71*a*.

As the actuator 110 rotationally moves in a direction, the output shaft 111 rotates in a direction. As the output shaft 111 rotates in a direction, the connection gear 130 and the connection cam 131 rotate clockwise. When the connection cam 131 rotates clockwise, the end portion 141 of the connection link 140 is pressurized by the connection cam 131. The connection link 140 pressurized by the connection cam 131 rotates counter-clockwise around the rotation axis A4. As the connection link 140 rotates, the boss B inserted into the connection hole 144 of the connection link 140 and the housing 71*c* including the boss B move. Thus, the transfer belt unit 71 rotationally moves clockwise around the roller rotation axis serving as the center of rotation.

As the actuator 110 rotates in the opposite direction, the connection gear 130 and the connection cam 131 in the counterclockwise direction which is opposite to the direction described above, and the connection link 140 rotates clockwise. Thus, the housing 71*c* and the transfer belt unit 71 rotationally move counterclockwise around the roller rotation axis A2 serving as the center of rotation. Such an operation is substantially the same as the case when the actuator 110 rotates in the direction, except for a direction, and thus a repetitive description will not be provided. The toner remaining in the transfer belt 71*b* is removed from the transfer belt 71*b* by the cleaning unit 74. The removed waste toner is conveyed to the waste toner receiving container 73. The conveyed toner is received in the waste toner receiving container 73. The waste toner receiving container 73 is disposed in an opposite side of the photosensitive drum 40, with the transfer belt unit 71 between the waste toner receiving container 73 and the photosensitive drum 40. That is, the transfer belt unit 71 is disposed between the photosensitive drum 40 and the waste toner receiving container 73.

Figure 7:
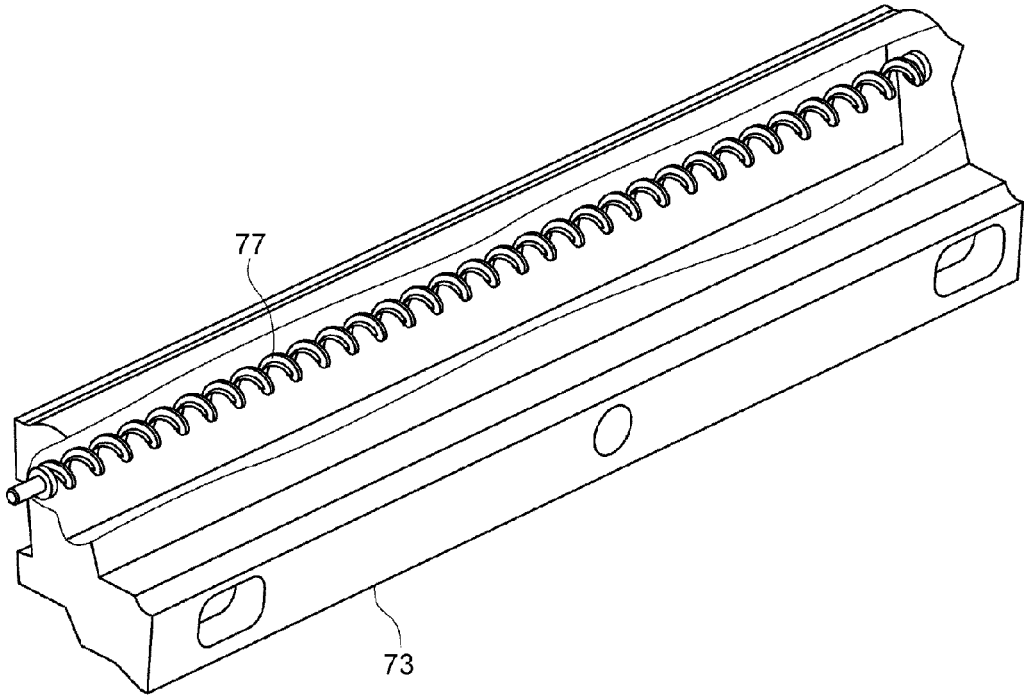
FIG. 7 is a perspective view illustrating a waste toner receiving container and a waste toner stirring unit.

As shown in FIGS. 2 and 7, a waste toner stirring unit 77 is provided inside the waste toner receiving container 73. The waste toner stirring unit 77 flattens a surface TF of waste toner 72 accumulated in the waste toner receiving container 73 (see FIG. 9A). The waste toner stirring unit 77 includes a screw-type stirring unit extending in an extending direction of the waste toner receiving container 73. As the waste toner stirring unit 77 rotates or rotates reversely, the waste toner 72 accumulated in the waste toner receiving container 73 is stirred and thus the surface TF of the accumulated waste toner 72 is flattened. The waste toner stirring unit 77 may be rotationally actuated by a motor. In another embodiment, the waste toner stirring unit 77 may be rotationally actuated with rotational movement of the transfer belt unit 71 as an actuating source. For example, although not shown in figures, the waste toner stirring unit 77 may be rotationally actuated in cooperation with rotational movement of the transfer belt unit 71.

As shown in FIG. 2, the amount of waste toner 72 received and accumulated in the waste toner receiving container 73 is managed by a full state detection unit FG. The full state detection unit FG detects whether the amount of waste toner 72 accumulated in the waste toner receiving container 73 reaches a preset full level. Herein, "full" means a state in which the waste toner 72 accumulated in the waste toner receiving container 73 reaches a preset amount and thus is full of the waste toner 72. The full state detection unit FG may include a full state detection portion 78 and a full state detection sensor 79. The full state detection portion 78 mechanically detects a height of the accumulated waste toner 72. For example, the full state detection portion 78 contacts, on at least a portion thereof, the surface of the waste toner 72 to mechanically detect the height of the accumulated waste toner 72.

The full state detection sensor 79 detects whether the height of the accumulated waste toner 72 detected by the full state detection portion 78 is equal to a desired full level.

Figure 6:
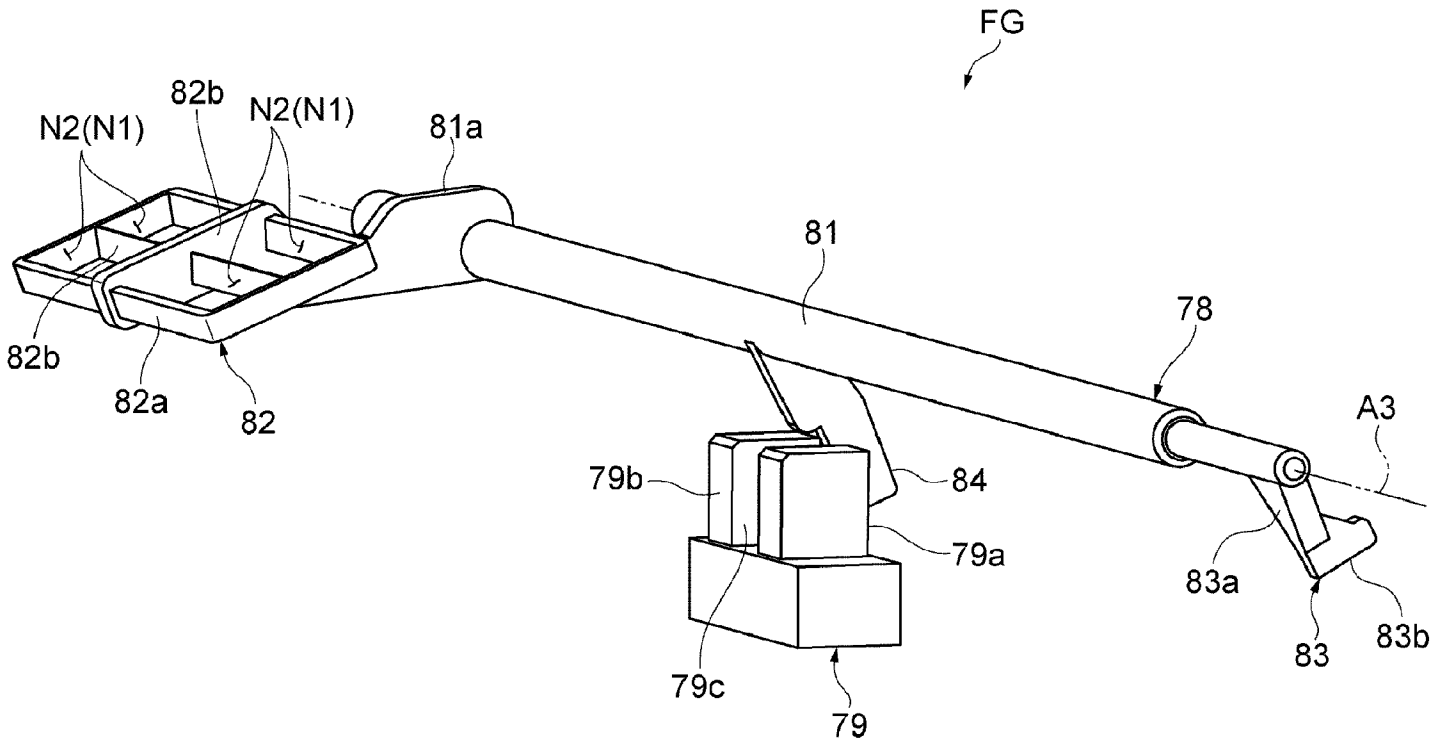
FIG. 6 is a perspective view illustrating a full state detection unit.

As shown in FIG. 6, the full state detection sensor 79 may include a light-emitting portion 79*a* and a light-receiving portion 79*b*. The light-emitting portion 79*a* emits sensor light. The light-receiving portion 79*b* is disposed spaced apart from the light-emitting portion 79*a* by a predetermined distance on a light path of the sensor light. The full state detection sensor 79 has a first state in which the sensor light is detected by the light-receiving portion 79*b* and a second state in which the sensor light is not received by the light-receiving portion 79*b*. In the current embodiment, the first state is a state in which the accumulated waste toner 72 is not in a full state and the second state is a state in which the accumulated waste toner 72 is in the full state. However, this is merely an example, and the first state and the second state may be reverse to the example. For example, the first state may be a state in which the accumulated waste toner 72 is in the full state and the second state is a state in which the accumulated waste toner 72 is not in the full state.

The full state detection unit 78 may include a shaft portion 81, a waste toner amount detection unit 82 mounted in an end of the shaft portion 81 with an arm portion 81*a* between the waste toner amount detection unit 82 and the shaft portion 81, a link portion 83 mounted in another end of the shaft portion 81, and a light-blocking portion 84 disposed between the waste toner amount detection unit 82 and the link portion 83.

The shaft portion 81 has the shape of a round bar extending along a rotation axis A3 that is parallel to the rotation axis A2. Both ends of the shaft portion 81 are supported to rotate along a circumference of the rotation axis A3 of the shaft portion 81.

The waste toner amount detection unit 82 is disposed in the waste toner receiving container 73. The waste toner amount detection unit 82 detects a height of the waste toner 72 received and accumulated in the waste toner receiving container 73. The waste toner amount detection unit 82 may have one or more (e.g., four) opening portions (a second opening portion N2). The waste toner amount detection unit 82 is in the form of a frame parallel to the rotation axis A3 of the shaft portion 81. The length of the waste toner amount detection unit 82 along the rotation axis A3 may be about ½—about ⅛ of the waste toner receiving container 73 along the rotation axis A3. The waste toner amount detection unit 82 is disposed approximately in the center of the waste toner receiving container along the rotation axis A3. The waste toner amount detection unit 82 includes an outer frame portion 82*a* and a split-beam portion 82*b*.

The split-beam portion 82*b* divides a first opening portion N1 enclosed by the outer frame 82*a* into a plurality of second opening portions N2. Herein, a total area of the second opening portions N2 is greater than about 0.1 $mm^2$ and less than and equal to about 300 $mm^2$. Preferably, the total area may be greater than and equal to about 50 $mm^2$ and less than and equal to about 250 $mm^2$. More preferably, the total area may be greater than and equal to about 50 $mm^2$ and less than and equal to about 100 $mm^2$.

The waste toner amount detection unit 82 is mounted on the arm portion 81*a*. The arm portion 81*a* is mounted at an end thereof on the shaft portion 81 to be orthogonal to the rotation axis A3 of the shaft portion 81. That is, the waste toner amount detection unit 82 is mounted on the shaft portion 81 by the arm portion 81*a* and is spaced apart from the shaft portion 81 in parallel by a distance equal to the length of the arm portion 81*a*. The length of the arm portion 81*a* may be specified, for example, by the detected height of the accumulated waste toner 82.

Figure 8:
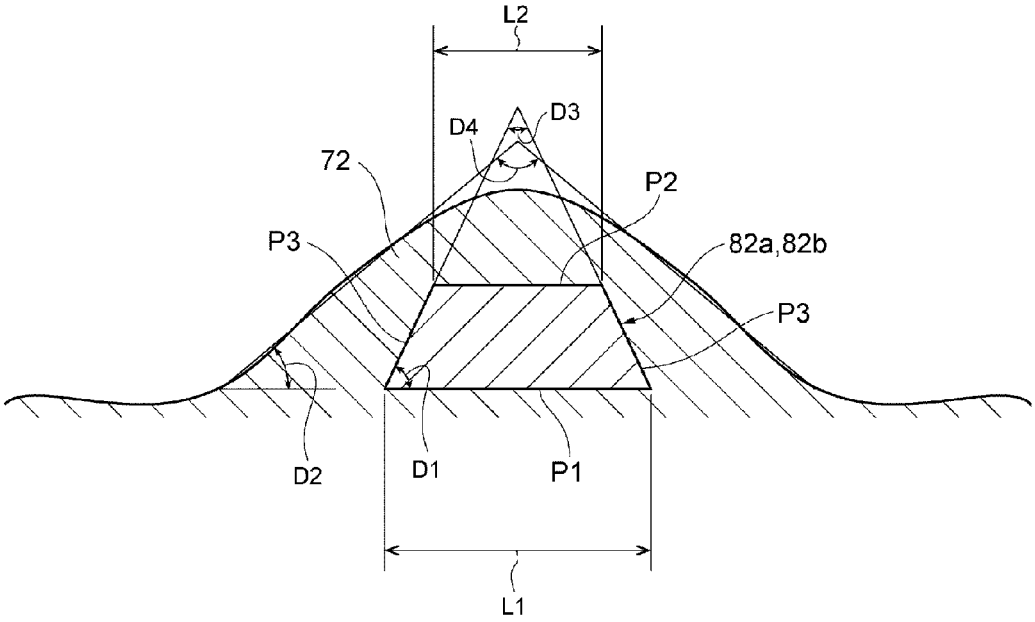
FIG. 8 is a cross-sectional view illustrating a relationship between waste toner and a waste toner amount detection unit.

The waste toner amount detection unit 82 may have a trapezoid cross section. More specifically, as shown in FIGS. 6 and 8, the outer frame portion 82*a* and the split-beam portion 82*b* of the waste toner amount detection unit 82 may have a trapezoid cross section. The outer frame portion 82*a* and the split-beam portion 82*b* have a bottom surface P1 that contacts facing the accumulated waste toner 72 and a top surface P2 that is opposite to the bottom surface P1. When the outer frame portion 82*a* and the split-beam portion 82*b* are viewed from a cross-sectional direction, a length L1 of the bottom surface P1 is longer than a length L2 of the top surface P2. That is, an area of the bottom surface P1 is greater than an area of the top surface P2. The outer frame portion 82*a* and the split-beam portion 82*b* have a pair of inclined surfaces P3 that connect the bottom surface P1 with the top surface P2. An angle D1 formed between the inclined surface P3 and the bottom surface P1 may be greater than a first angle of repose D2 of the accumulated waste toner 72. An angle D3 between the pair of inclined surfaces P3 in the outer frame portion 82*a* and the split-beam portion 82*b* is less than a second angle of repose D4 of the accumulated waste toner 72.

Herein, an angle of repose of the accumulated waste toner 72 will be described. The angle of repose refers to an angle that does not cause powder or particles not to fall down when the powder or particles are piled up like a mountain. Generally, an angle of repose refers to an angle between a bottom surface and an inclined surface when powder or particles are piled up like a mountain. The first angle of repose D2 in the current embodiment corresponds to such an angle of repose. An angle between inclined surfaces of the accumulated waste toner 82 accumulated like a mountain is referred to as the second angle of repose D4 in the current embodiment.

Figure 9A:
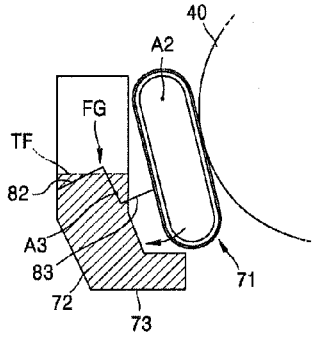
FIGS. 9A, 9B and 9C are side views for describing an operation of a full state detection unit.
Figure 9B:
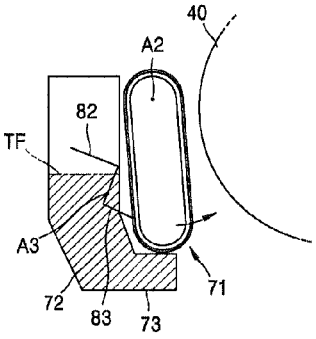
Figure 9C:
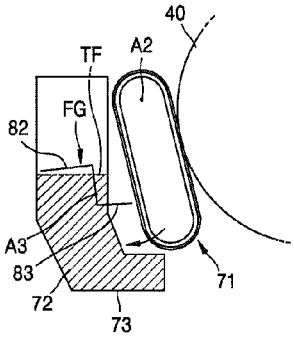

A state of the waste toner amount detection unit 82 will be described. As shown in FIGS. 9A, 9B and 9C, the waste toner amount detection unit 82 has three states including a buried state, a non-buried state, and a loaded state in the waste toner receiving container 73. These three states may be changed by rotation of the circumference of the rotation axis A3. In the buried state (see FIG. 9A), the waste toner amount detection unit 82 is entirely or partially buried in the accumulated waste toner 72. The waste toner 72 is received in the waste toner receiving container 73 through a waste toner inlet (not shown) formed above the waste toner amount detection unit 82. Thus, in the waste toner amount detection unit 82, the waste toner 72 is accumulated. In the non-buried state (see FIG. 9B), the waste toner amount detection unit 82 is positioned in a space above the surface TF of the accumulated waste toner 72 without contacting the accumulated waste toner 72. In the loaded state (see FIG. 9C), the waste toner amount detection unit 82 contacts the surface TF of the accumulated waste toner 72. More specifically, the bottom surface P1 of the waste toner amount detection unit 82 partially or entirely contacts the surface TF of the accumulated waste toner 72.

As shown in FIGS. 2 and 6, the link portion 83 is disposed between the transfer belt unit 71 and the waste toner receiving container 73. The link portion 83 contacts the transfer belt unit 71. The link portion 83 converts arc rotational movement of the transfer belt unit 71 into rotation of the shaft portion 81.

The link portion 83 may have an L shape when viewed from the rotation axis A3 of the shaft portion 81. For example, the link portion 83 may include a connection arm portion 83*a* and a contact arm portion 83*b*.

The connection arm portion 83*a* is mounted at an end thereof on the shaft portion 81 to be orthogonal to the rotation axis A3 of the shaft portion 81. The length of the connection arm portion 83*a* may be specified by, for example, a torque quantity generated by rotation of the shaft portion 81. The contact arm portion 83*b* extends in a direction orthogonal to an extending direction of the connection arm portion 83*a* from another end of the connection arm portion 83*a*. The length of the contact arm portion 83*b* may be specified by a necessary rotation angle of the shaft portion 81.

As shown in FIG. 6, the light-blocking portion 84 reciprocates through a gap 79*c* of the full state detection sensor 79 by rotation of the shaft portion 81. When the light-blocking portion 84 is positioned outside the gap 79*c* of the full state detection sensor 79, the full state is not detected. On the other hand, when the light-blocking portion 84 is positioned in the gap 79*c* of the full state detection sensor 79, the full state is detected. The light-blocking portion 84 is mounted in a rotation angle range of the shaft portion 81 or to have an angle from the arm portion 81*a* of the waste toner amount detection unit 82.

Hereinafter, a working effect of the image forming apparatus 1 having the full state detection unit 78 will be described.

In the image forming apparatus 1, the full state detection unit 78 has a simple structure including the waste toner amount detection unit 82. The full state detection unit 78 determines a full state in the loaded state in which the waste toner amount detection unit 82 is loaded on the surface TF of the accumulated waste toner 72. Herein, the loaded state has been switched from the non-buried state in which the waste toner amount detection unit 82 is not buried in the accumulated waste toner 72. Thus, the accumulated waste toner 72 does not exist in the waste toner amount detection unit 82 in the loaded state. Thus, the amount of accumulated waste toner 72 corresponding to a height-wise position of the waste toner amount detection unit 82 may be detected with high precision. In this way, with a simple structure, detection of the full state of the accumulated waste toner 72 may be improved.

The buried state, the non-buried state, and the loaded state of the waste toner amount detection unit 82 are switched in cooperation with rotational movement of the transfer belt unit 71. With this structure, the state of the waste toner amount detection unit 82 is switched in cooperation with rotational movement of the transfer belt unit 71, removing a need for adding a new actuating source for changing the state of the waste toner amount detection unit 82. Therefore, by suppressing an increase in the number of parts, the structure of the device may become simple.

The transfer belt unit 71 has an away state in which a predetermined distance from the photosensitive drum 40, which is an image holding member, is a specific distance and a close state in which a distance from the photosensitive drum 40 is shorter than the predetermined distance in the away state. The waste toner amount detection unit 82 switches from the buried state to the non-buried state to correspond to the switch of the transfer belt unit 71 from the close state to the away state. The waste toner amount detection unit 82 switches from the non-buried state to the loaded state to correspond to the switch of the transfer belt unit 71 from the away state to the close state. With this structure, timing of an image forming operation of the transfer belt unit 71 and timing of a full detecting operation of the full state detection unit 78 may be set to have a specific relationship. Thus, without adding a new part, the full state detection operation of the full state detection unit 78 may be performed with specific timing.

The full state detection unit 78 includes the shaft portion 81 and the link portion 83. The extending direction of the shaft portion 81 is parallel with the extending direction of the roller rotation axis A2. The link portion 83 is disposed between the transfer belt unit 71 and the waste toner receiving container 73 to contact the transfer belt unit 71. The link portion 83 is mounted on the shaft portion 81 to protrude toward the transfer belt unit 71 from the shaft portion 81. The waste toner amount detection unit 82 is mounted on the shaft portion 81 to protrude toward the waste toner receiving container 73 from the shaft portion 81. By using the full state detection unit 78, an actuating force based on rotational movement of the transfer belt unit 71 may be efficiently delivered to the waste toner amount detection unit 82.

The waste toner amount detection unit 82 has a trapezoid cross section, and a width of the bottom surface P1 contacting the accumulated waste toner 72 is longer than a width of the top surface P2 opposite to the bottom surface P1. When the waste toner amount detection unit 82 switches from the buried state to the non-buried state, an area for pushing up the accumulated waste toner 72 vertically is reduced. Thus, an actuating force necessary for the switch from the buried state to the non-buried state may also be reduced. In addition, in the loaded state, an area contacting the accumulated waste toner 72 increases. Therefore, sinking of the waste toner amount detection unit 82 due to dead weight in the loaded state may be suppressed.

The waste toner amount detection unit 82 has the pair of inclined surfaces P3 connecting the bottom surface P1 with the top surface P2. The angle D1 between the inclined surface P3 and the bottom surface P1 that push up the accumulated waste toner 72 is greater than the first angle of repose D2 of the accumulated waste toner 72. The first angle of repose D2 may be greater than 20 degrees. With the waste toner amount detection unit 82, the waste toner 72 accumulated on the waste toner amount detection unit 82 easily collapses. Thus, an actuating force necessary for switch from the buried state to the non-buried state is reduced. Therefore, the amount of accumulated waste toner 72 remaining on the waste toner amount detection unit in the non-buried state may be reduced.

The full state detection unit 78 has the outer frame portion 82*a* and the split-beam portion 82*b*. The outer frame portion 82*a* forms the first opening portion N1. The split-beam portion 82*b* is disposed in the first opening portion N1 to divide the first opening portion N1 into a plurality of second opening portions N2. With this structure, the weight of the waste toner amount detection unit 82 is reduced, thereby suppressing sinking of the waste toner amount detection unit 82. Moreover, the waste toner 72 accumulated on the waste toner amount detection unit 82 falls from the second opening portion N2 during the switch from the buried state to the non-buried state, such that the amount of accumulated waste toner 72 remaining on the waste toner amount detection unit 82 in the non-buried state may be reduced.

A total area of the second opening portions N2 may be greater than and equal to about 0.1 $mm^2$ and less than and equal to about 300 $mm^2$. By suppressing the sinking of the waste toner amount detection unit 82 with the full state detection unit 78 having the second opening portions N2, full state detection may be accurately performed.

The outer frame portion 82*a* and the split-beam portion 82*b* have a trapezoid cross section including the pair of inclined surfaces P3. The angle D3 between the pair of inclined surfaces P3 is less than and equal to the second angle of repose D4 of the accumulated waste toner 72. With the outer frame portion 82*a* and the split-beam portion 82*b*, the waste toner 72 accumulated on the waste toner amount detection unit 82 easily collapses. Thus, an actuating force necessary for the switch from the buried state to the non-buried state is further reduced. Therefore, the amount of waste toner 72 remaining on the waste toner amount detection unit 82 in the non-buried state may be further reduced.

Next, referring to FIG. 10, operations of the image forming apparatus 1 including the full state detection unit 78 will be described.

First, image formation control for forming an image on the paper P is performed in operation S1. As shown in FIG. 1, an image signal of an image to be recorded is input to the image forming apparatus 1. The control unit 90 of the image forming apparatus 1 uniformly electrifies the surface of the photosensitive drum 40 to a specific potential by the conditioning roller 41 based on the received image signal. The control unit 90 then irradiates laser light onto the surface of the photosensitive drum 40 by the writing unit 42 to form an electrostatic latent image.

The developing unit 20 supplies toner to the electrostatic latent image formed on the photosensitive drum 40 to form the toner image on an outer circumferential surface of the photosensitive drum 40. The toner image formed in this way is transferred to the paper P conveyed from the recording medium convey unit 10.

The control unit 90 conveys the paper P onto which the toner image is transferred to the fusing unit 50. The paper P is caused to pass through between the heat roller 51 and the pressure roller 52 by applying heat and pressure, thereby fusing the toner image on the paper P. The control unit 90 discharges the paper P to the outside of the image forming apparatus 1 by the discharge rollers 61 and 62.

Herein, operations of the full state detection unit 78 in the image print process S1 will be described in detail. As shown in FIG. 9A, during the print process S1, the transfer belt unit 71 is pressurized to the photosensitive drum 40. That is, the transfer belt unit 71 is pressured by (is close to) the photosensitive drum 40. Thus, the waste toner amount detection unit 82 of the full state detection unit 78 contacts the surface of the accumulated waste toner 72 by the weight of the waste toner amount detection unit 82. During the print process S1, the waste toner 72 collected from an upper portion of the waste toner receiving container 73 comes in and the waste toner 72 is accumulated on the waste toner amount detection unit 82. Thus, the waste toner amount detection unit 82 gradually sinks in the accumulated waste toner 72 and thus enters the buried state.

Figure 10:
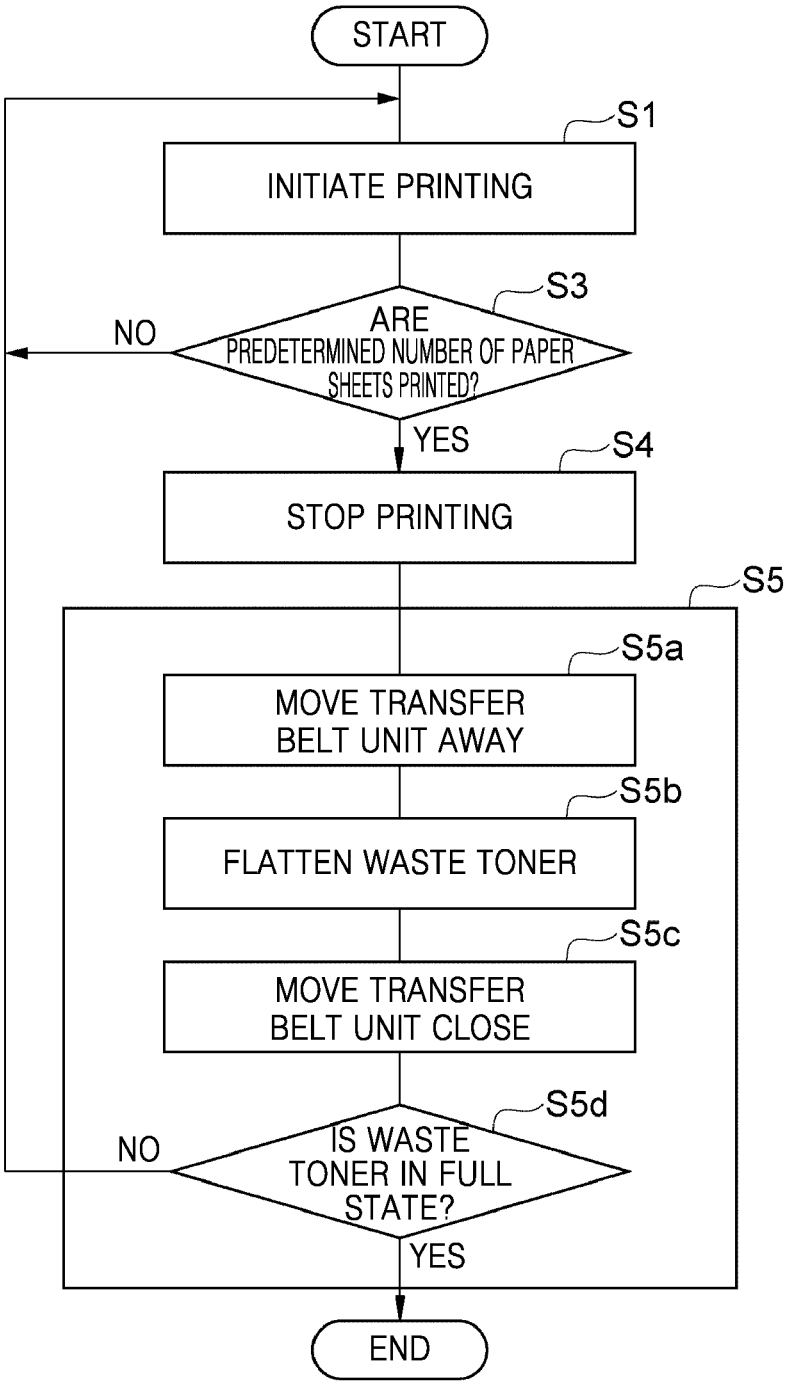
FIG. 10 is a flowchart illustrating a process performed by a control unit.

As shown in FIG. 10, the above-described print process S1 is repeated while determining whether printing of a specific number of paper sheets is performed in operation S3. For example, if it is not determined that printing is performed a predetermined number of times (e.g., 100 times) (S3: NO), the print process S1 is performed again. If it is determined that printing is performed a predetermined number of times (S3: YES), printing is stopped in operation S4. Until the print process S1 is resumed after the print process S1 is stopped, a full state detection process S5 is performed.

As shown in FIGS. 9A and 9B, if the print process S1 is stopped, the control unit 90 performs non-buried control. More specifically, the control unit 90 causes the transfer belt unit 71 to move away from the photosensitive drum 40 by rotating the transfer belt unit 71 around the roller rotation axis A2 in operation S5*a*. That is, the transfer belt unit 71 rotates about the roller rotation axis A2 to switch from the close state to the away state. By rotation of the transfer belt unit 71, the roller rotation axis A2 of the transfer belt unit 71 and the link portion 83 contacting an opposite lower portion are pressurized. Once the link portion 83 is pressurized, the full state detection unit 78 rotationally moves around the rotation axis A3. By the rotational movement, the waste toner amount detection unit 82 bounces above the surface of the accumulated waste toner 72, thus moving above the surface TF of the accumulated waste toner 72 (the non-buried state). That is, the waste toner amount detecting unit 82 switches from the buried state to the non-buried state. In this process, the waste toner amount detection unit 82 moves up while pushing aside the waste toner 72 accumulated on the waste toner amount detection unit 82.

The control unit 90 then performs flattening control after executing non-buried control in operation S5*b*. More specifically, the control unit 90 actuates a stirring actuating unit for actuating the waste toner stirring unit 77 to rotate or reversely rotate the waste toner stirring unit 77 (see FIG. 7). By the rotational movement of the waste toner stirring unit 77, the surface TF of the accumulated waste toner 72 is flattened.

The control unit 90 continues flattening control and then performs loading control. More specifically, the control unit 90 rotates the transfer belt unit 71 reversely around the roller rotation axis A2 to pressurize the transfer belt unit 71 to the photosensitive drum 40 in operation S5*c*. That is, the transfer belt unit 71 rotates reversely around the roller rotation axis A2, thus switching from the away state to the close state. Through reverse rotation of the transfer belt unit 71, the link portion 83 is released from the pressure applied by the transfer belt unit 71. Upon release of the pressure applied to the link portion 83, the full state detection unit 78 rotates reversely around the shaft portion 81 as the center axis of rotation due to the weight of the waste toner amount detection unit 82. Due to the reverse rotation of the full state detection unit 78, the waste toner amount detection unit 82 moves toward the surface TF of the accumulated waste toner 72 and thus is loaded on the surface TF of the accumulated waste toner 72 (the loaded state).

The control unit 90 continues loading control and then performs determination control for determining whether the height of the accumulated waste toner 72 is greater than a threshold value in operation S5*d*. More specifically, the control unit 90 determines whether sensor light emitted from the light-emitting portion 79*a* is detected in the light-receiving portion 79*b* of the full state detection sensor 79.

In the case of the accumulated waste toner 72 not being in the full state, if the waste toner amount detection unit 82 is loaded on the surface TF of the accumulated waste toner 72, the light-blocking portion 84 mounted on the shaft portion 81 of the full state detection unit 78 is not disposed between the light-receiving portion 79*b* and the light-emitting portion 79*a*. Thus, the sensor light emitted from the light-emitting portion 79*a* is not blocked and is incident to the light-receiving portion 79*b* in which the sensor light is detected. Therefore, it is determined that the accumulated waste toner 72 is not in the full state in operation S5*d* (NO). The control unit 90 performs the print process S1.

In the case of the accumulated waste toner 72 being in the full state, if the waste toner amount detection unit 82 is loaded on the surface TF of the accumulated waste toner 72, the light-blocking portion 84 mounted on the shaft portion 81 of the full state detection unit 78 is disposed between the light-receiving portion 79*b* and the light-emitting portion 79*a* and blocks the sensor light. Thus, the control unit 90 determines the full state because the sensor light is not detected in the light-receiving portion 79*b* in operation S5*d* (YES). In this case, the control unit 90 encourages an operation such as replacement by displaying the full state of the waste toner receiving container 73 by using a lamp or a display panel provided on the image forming apparatus 1.

The control unit 90 may cause the waste toner 72 accumulated on the waste toner amount detection unit 82 to fall down to perform control for switching the buried state of the waste toner amount detection unit 82 to the non-buried state. To switch the waste toner amount detection unit 82 in the non-buried state to the loaded state, the accumulated waste toner 72 does not exist on the waste toner amount detection unit 82 in the loaded state. Thus, the amount of accumulated waste toner 72 may be detected with high precision based on a height-wise position of the waste toner amount detection unit 82, thereby improving the precision of the full state detection of the accumulated waste toner 72 with a simple structure.

The control unit 90 performs flattening control for flattening the accumulated waste toner 72 by controlling the waste toner stirring unit 77 to operate, after the loading control and before the determination control. By using the waste toner stirring unit 77, the height of the accumulated waste toner 72 may become almost uniform when the waste toner amount detection unit 82 is lifted. Since the waste toner amount detection unit 82 is loaded on the surface TF of the accumulated waste toner 72 whose height become almost uniform, the precision of full state detection may be further improved. Moreover, the receiving efficiency of the accumulated waste toner 72 in the waste toner receiving container 73 may be enhanced.

Figure 11:
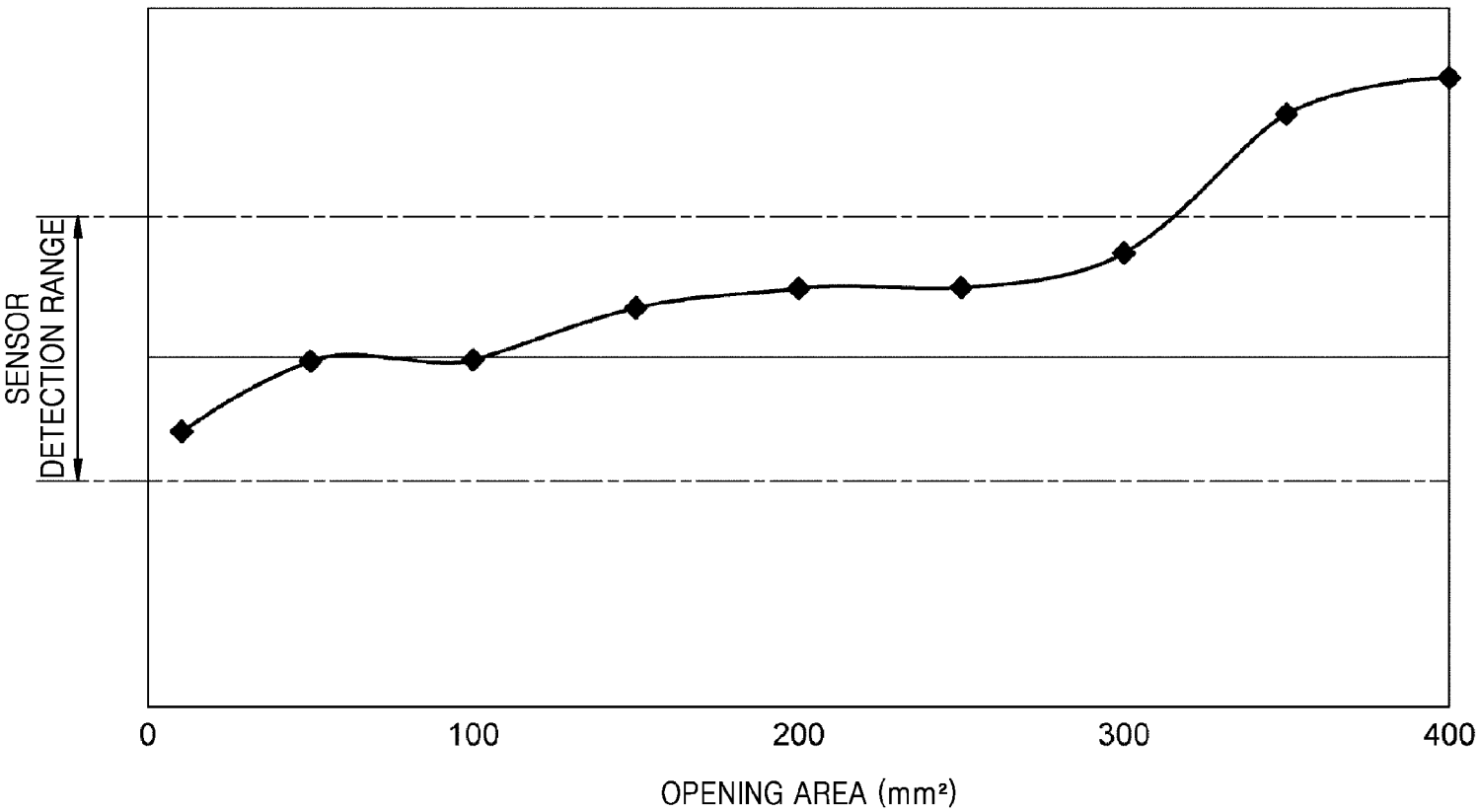
FIG. 11 is a graph for describing Embodiment 1.

As shown in FIG. 11, in Embodiment 1, a relationship between a total area of the second opening portions N2 and a detectable range of the full state detection sensor 79 is identified. To detect the height of the surface TF of the accumulated waste toner 72 with high precision by the waste toner amount detection unit 82, the waste toner amount detection unit 82 needs to be maintained at the same height as the surface TF of the accumulated waste toner 72. For example, if the area of the second opening portions N2 is large, the area of the waste toner amount detection unit 82 contacting the accumulated waste toner 72 is small. The small contact area means that the waste toner amount detection unit 82 sinks in the accumulated waste toner 72 due to the dead weight of the waste toner amount detection unit 82, hindering high-precision detection of the height of the accumulated waste toner 72.

In Embodiment 1, the entire area of the waste toner amount detection unit 82 including the second opening portions N2 is about 800 $mm^2$ and the total area of the second opening portions N2 is assumed to be about 0.1 $mm^2$, about 50 $mm^2$, about 100 $mm^2$, about 150 $mm^2$, about 200 $mm^2$, about 250 $mm^2$, about 300 $mm^2$, about 350 $mm^2$, and about 400 $mm^2$, with respect to the entire area. The weight of the waste toner amount detection unit 82 is about 50 g, for example, when the total area is 400 $mm^2$. Then, the waste toner amount detection unit 82 is loaded on the surface TF of the waste toner 72 accumulated in the waste toner receiving container 73 that receives the waste toner 72 in the full state, and then it is determined whether the full state detection sensor 79 is capable of performing detection. As a result, when the total area of the second opening portions N2 is in a range of about 0.1 $mm^2$ to about 300 $mm^2$, the full state may be accurately detected. Meanwhile, in the case of 350 $mm^2$ and 400 $mm^2$, the waste toner amount detection unit 82 sinks and thus may not detect the full state. Thus, the total area of the second opening portions N2 in the waste toner amount detection unit 82 may be in a range of about 0.1 $mm^2$ to about 300 $mm^2$, for detection.

The sinking of the waste toner amount detection unit 82 in the accumulated waste toner 72 is affected by the weight of the waste toner amount detection unit 82, an area contacting the accumulated waste toner 72, and a material of the accumulated waste toner 72. The above-described range is an example, and a range of the total area is not limited to the above-described range.

As shown in FIG. 12, in Embodiment 2, a resisting force that resists the accumulated waste toner 72 in the case of switch of the waste toner amount detection unit 82 from the buried state to the non-buried state is considered. In consideration of the resisting force, the angle D1 in the waste toner amount detection unit 82 and the first angle of repose D2 of the waste toner 72 accumulated like a mountain are selected as parameters and a desirable combination of the angle D1 and the first angle of repose D2 is examined.

In FIG. 12, a circular indication (○) indicates a small resisting force for resisting the accumulated waste toner 72, a triangular indication (Δ) indicates a slightly large resisting force for resisting the accumulated waste toner 72, and an x indication (×) indicates a large resisting force for resisting the accumulated waste toner 72.

When the angle D1 of the waste toner amount detection unit 82 is about 70 degrees, the resisting force is small when the first angle of repose D2 is in a range of about 0 degree to about 40 degrees. When the angle D1 of the waste toner amount detection unit 82 is about 60 degrees, the resisting force is small when the first angle of repose D2 is in a range of about 0 degree to about 30 degrees and the resisting force is relatively large when the first angle of repose D2 is about 40 degrees. When the angle D1 of the waste toner amount detection unit 82 is about 50 degrees, the resisting force is small when the first angle of repose D2 is about 0 degree and about 10 degrees and the resisting force is relatively large when the first angle of repose D2 is about 20 degrees to about 40 degrees. When the angle D1 of the waste toner amount detection unit 82 is about 40 degrees, the resisting force is relatively large when the first angle of repose D2 is in a range of about 0 degree to about 30 degrees and the resisting force is large when the first angle of repose D2 is about 40 degrees. When the angle D1 of the waste toner amount detection unit 82 is about 30 degrees, the resisting force is relatively large when the first angle of repose D2 is in a range of about 10 degrees to about 20 degrees, and the resisting force is large when the first angle of repose D2 is about 0 degree, about 30 degrees, and about 40 degrees. When the angle D1 of the waste toner amount detection unit 82 is in a range of about 0 degree to about 20 degrees, the resisting force is large when the first angle of repose of the accumulated waste toner 72 is in a range of about 0 degree to about 40 degrees.

Thus, based on the resisting force for resisting the accumulated waste toner 72, a combination of the angle D1 of the waste toner amount detection unit 82 of 70 degrees and the first angle D2 of the accumulated waste toner 72 in a range of about 0 degree to about 40 degrees, a combination of the angle D1 of 60 degrees and the first angle D2 in a range of about 0 degree to about 30 degrees, and a combination of the angle D1 of 50 degrees and the first angle D2 in a range of about 0 degree to about 10 degrees are desirable.

The present disclosure is not limited to the foregoing embodiments, and various changes may be made without departing from the subject matter of the present disclosure. For example, the waste toner stirring unit 77 may operate in cooperation with movement of the transfer belt unit 71. With this structure, an actuating source for operating the waste toner stirring unit is not separately needed. In this way, by suppressing an increase in the number of parts, the structure of the device may be simplified.

Moreover, the full state detection unit according to the present disclosure may be applied to a transfer belt and an intermediate transfer belt of an image forming apparatus.

To help understanding of the present disclosure, reference numerals have been described in the embodiments shown in the drawings and specific terms for describing the embodiments have been used, but the present disclosure is not limited by the specific terms and the present disclosure may include any elements that may be conceived typically by those of ordinary skill in the art.

Specific executions described in the present disclosure are embodiments, and do not limit the scope of the present disclosure in any way. For brevity of the specification, conventional electronic components, control systems, software, and other functional aspects of the systems may not be described. Connection or connection members of lines between illustrated elements illustrate functional connection and/or physical or circuit connections, and may be indicated as replaceable or additional various functional connections, physical connections or circuit connections in actual devices. Unless mentioned in detail such as "essential", "important", or the like, an element may not be an element that is necessarily needed for application of the present disclosure. An expression used herein, such as "comprising", "including", or the like has been used to be understood as an open-ended term.

In the present disclosure, the use of all examples or exemplary terms (e.g., and so forth) is merely intended to describe the present disclosure in detail, and the scope of the present disclosure is not limited by the examples or exemplary terms unless specified by the claims. It will be also clearly understood by those of ordinary skill in the art that various modifications and changes may be easily made without departing the scope and spirit of the present disclosure.

EXPLANATION OF SYMBOLS

1,1A . . . Image Forming Apparatus, 10 . . . Recording Medium Convey Unit, 20 . . . Developing Unit, 21 . . . Developing Roller, 22 . . . Toner Tank, 30 . . . Transfer Member, 31 . . . Transfer Belt, 32 . . . Primary Transfer Roller, 33 . . . Secondary Transfer Roller, 40 . . . Photosensitive Drum, 41 . . . Conditioning Roller, 42 . . . Writing Unit, 43 . . . Cleaning Unit, 50 . . . Fusing Unit, 51 . . . Heat Roller, 52 . . . Pressure Roller, 61 . . . Discharge Roller, 70 . . . Transfer Member, 71 . . . Transfer Belt Unit, 71*a* . . . Suspension Roller, 71*b* . . . Transfer Belt, 72 . . . Accumulated Waste Toner, 73 . . . Waste Toner Receiving Container (Waste Toner Receiving Member), 76 . . . Photosensitive Drum, 77 . . . Waste Toner Stirring Unit, 78 . . . Full State Detection Unit, 79 . . . Full State Detection Sensor, 81 . . . Shaft Portion, 82 . . . Waste Toner Amount Detection Unit, 82*a* . . . Outer Frame Portion, 82*b* . . . Split-Beam Portion, 83 . . . Link Portion, 84 . . . Light-Blocking Portion, 90 . . . Control Unit, A1 . . . Rotation Support Portion, A2 . . . Roller Rotation Axis, A3 . . . Rotation Axis, D2 . . . First Angle of Repose, D4 . . . Second Angle of Repose, FG . . . Full State Detection Unit, L1 . . . Lower Bottom Portion, L2 . . . Upper Bottom Portion, P . . . Paper, P1 . . . Bottom Surface, P2 . . . Top Surface, P3 . . . Inclined Surface, R1 . . . Convey Path, R2 . . . Secondary Transfer Region, N1 . . . First Opening Portion, N2 . . . Second Opening Portion, T . . . Cassette, TF . . . Surface

The invention claimed is:

1. An image forming apparatus comprising:

an image holding member in which a toner image is held;

a transfer member configured to transfer the toner image to a transfer material;

a cleaning unit configured to remove waste toner remaining on the image holding member;

a waste toner receiving member configured to receive the waste toner removed by the cleaning unit; and a full state detection unit comprising a waste toner amount detection unit disposed in the waste toner receiving member to detect an amount of waste toner and configured to detect whether the waste toner is fully filled in the waste toner receiving member by using the waste toner amount detection unit, wherein the waste toner amount detection unit is movable in a buried state in which the waste toner amount detection unit is positioned under a surface of the waste toner received in the waste toner receiving member, in a non-buried state in which the waste toner amount detection unit is positioned above the surface of the waste toner, and in a loaded state in which the waste toner amount detection unit contacts the surface of the waste toner, and the full state detection unit detects whether the waste toner is fully filled in the waste toner receiving member when the waste toner amount detection unit is positioned in the loaded state switched from the non-buried state.

2. The image forming apparatus of claim 1, wherein the transfer member is movable, and the waste toner amount detection unit switches to the buried state, the non-buried state, or the loaded state in cooperation with movement of the transfer member.

3. The image forming apparatus of claim 2, further comprising:

an actuator configured to provide a rotation force; and a connection portion disposed between the actuator and the transfer member and configured to deliver the rotation force of the actuator to the transfer member, wherein by the rotation force of the actuator, the transfer member moves in an away state in which the transfer member is spaced apart by a predetermined distance from the image holding member and in a close state in which the transfer member is closer to the image holding member than in the away state.

4. The image forming apparatus of claim 2, further comprising:

a case on which the image holding member is fixedly installed; and a cover configured to open and close the case and on which the transfer member is mounted, wherein by opening and closing of the cover, the transfer member moves in an away state in which the transfer member is spaced apart by a predetermined distance from the image holding member and in a close state in which the transfer member is closer to the image holding member than in the away state.

5. The image forming apparatus of claim 1, wherein the transfer member is movable in an away state in which the transfer member is spaced apart by a predetermined distance from the image holding member and in a close state in which the transfer member is closer to the image holding member than in the away state, and in the full state detection unit, the waste toner amount detection unit switches from the buried state to the non-buried state to correspond to movement of the transfer member from the close state to the away state, and switches from the non-buried state to the loaded state to correspond to movement of the transfer member from the away state to the close state.

6. The image forming apparatus of claim 5, wherein the full state detection unit is configured to be pressurized in contact with the transfer member when the transfer member moves from the close state to the away state, and the full state detection unit is configured to be released from the contact pressurization by the transfer member when the transfer member moves from the away state to the close state.

7. The image forming apparatus of claim 6, wherein the full state detection unit comprises a rotatable shaft on which the waste toner amount detection unit is mounted and a link portion that protrudes from the shaft toward the transfer member and is contactable to the transfer member.

8. The image forming apparatus of claim 5, further comprising:

a control unit configured to control operations of the transfer member and the full state detection unit.

9. The image forming apparatus of claim 8, wherein the control unit is configured to perform non-buried control for switching the waste toner amount detection unit from the buried state to the non-buried state by moving the transfer member from the close state to the away state;

to perform loading control for switching the waste toner amount detection unit from the non-buried state to the loaded state by moving the transfer member from the away state to the close state after performing the non-buried control; and to perform determination control for determining whether the waste toner is in a full state after performing the loading control.

10. The image forming apparatus of claim 9, further comprising a waste toner stirring unit configured to flatten the waste toner received in the waste toner receiving member.

11. The image forming apparatus of claim 10, wherein the control unit performs flattening control for flattening the waste toner by operating the waste toner stirring unit after performing the loading control and before performing the determination control.

12. The image forming apparatus of claim 10, wherein the waste toner stirring unit operates in cooperation with movement of the transfer member.

13. The image forming apparatus of claim 8, wherein the control unit is configured to control image formation when the waste toner amount detection unit is in the buried state.

14. The image forming apparatus of claim 1, wherein the waste toner amount detection unit has a trapezoid cross section and has a top surface, a bottom surface having a wider width than the top surface, and a pair of inclined surfaces connecting the top surface with the bottom surface.

15. The image forming apparatus of claim 14, wherein an angle between the inclined surface and the bottom surface of the waste toner amount detection unit is greater than a first angle of repose that is an angle between a bottom surface and an inclined surface of the waste toner received in the waste toner receiving member.

16. The image forming apparatus of claim 1, wherein the waste toner amount detection unit comprises an outer frame portion forming a first opening portion and a split-beam portion disposed in the first opening portion to divide the first opening portion into a plurality of second opening portions.

17. The image forming apparatus of claim 16, wherein a total area of the second opening portions is greater than and equal to about 0.1 $mm^2$ and less than and equal to about 300 $mm^2$.

18. The image forming apparatus of claim 16, wherein at least one of the outer frame portion and the split-beam portion has a trapezoid cross section including a pair of inclined surfaces, and an angle between the pair of inclined surfaces is a second angle of repose that is an angle between inclined surfaces of the waste toner received in the waste toner receiving member.

19. The image forming apparatus of claim 1, wherein the waste toner receiving member is rotatable.

* * * * *